US006200359B1

(12) United States Patent
Grundy et al.

(10) Patent No.: US 6,200,359 B1
(45) Date of Patent: Mar. 13, 2001

(54) FUEL OIL COMPOSITION

(75) Inventors: Michael John Grundy; Andrea Redford, both of Chester (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/418,879

(22) Filed: Oct. 15, 1999

(30) Foreign Application Priority Data

Dec. 23, 1998 (EP) ..... 98310681

(51) Int. Cl.[7] ..... C01L 1/18; C01L 1/28
(52) U.S. Cl. ..... 44/320; 44/443
(58) Field of Search ..... 44/443, 320

(56) References Cited

U.S. PATENT DOCUMENTS

| | | | | |
|---|---|---|---|---|
| 4,046,521 | * | 9/1977 | Bessler et al. | 44/443 |
| 4,208,190 | | 6/1980 | Malec | 44/53 |
| 4,690,688 | | 9/1987 | Adams et al. | 44/76 |
| 5,542,960 | | 8/1996 | Grabowski | 44/320 |
| 5,613,988 | | 3/1997 | Spiegler et al. | 44/320 |

FOREIGN PATENT DOCUMENTS

| | | | | |
|---|---|---|---|---|
| 0147240 | | 7/1985 | (EP) | C10L/1/22 |
| 0482253 | | 4/1990 | (EP) | C10L/1/22 |
| 0557561 | | 9/1993 | (EP) | H04L/25/49 |
| 0613938 | | 9/1994 | (EP) | C10L/1/22 |
| 0849352 | | 6/1998 | (EP) | C10L/1/28 |
| 960493 | | 12/1961 | (GB) . | |
| 1306233 | | 2/1973 | (GB) | C10L/1/18 |
| 9801516 | * | 1/1998 | (WO) . | |
| 98/42808 | | 10/1998 | (WO) | C10L/1/22 |

* cited by examiner

*Primary Examiner*—Margaret Medley
*Assistant Examiner*—Cephia D. Toomer

(57) ABSTRACT

The invention discloses a fuel oil composition comprising a major proportion of a liquid hydrocarbon middle distillate fuel oil, from 1 to 100 ppmw based on the composition of a polyoxyalkylene glycol dehazer and from 1 to 100 ppmw based on the composition of an organosilicone antifoam additive, wherein before mixing of the organosilicone antifoam with any other component of the fuel oil composition, the organosilicone antifoam additive is heated at a temperature of at least 40° C. for a sufficient period of time to achieve improved antifoam properties of the fuel oil composition; a process for the preparation of such a fuel oil composition; and a method of fuelling a road vehicle with such a composition.

3 Claims, No Drawings

FUEL OIL COMPOSITION

FIELD OF THE INVENTION

This invention relates to fuel oil compositions, processes for their preparation and their use in fuelling road vehicles.

A common problem in the handling of liquid fuels, particularly fuel oil compositions, e.g. in the processing and transport of such fuels, but particularly in the fuelling of road vehicles, is foaming of the fuel.

A broad class of organosilicone antifoam additives for liquid hydrocarbon fuels, particularly fuel oils, has been developed, for example those commercially available under the "TEGOPREN" trade mark ex Th. Goldschmidt A. G. (e.g. "T 5851" and "MR 2068"), Q25907 (ex Dow Corning), under the "RHODORSIL" trade mark ex Rhone Poulenc, or under the "SAG" trade mark ex OSi Specialties (e.g. "TP-325" and "Y-14326").

Organosilicone antifoam additives, which are siloxane-containing compounds, are described, for example in U.S. Pat. No. 4,690,688 (Dow Corning), U.S. Pat. No. 5,542,960 (Osi Specialties), U.S. Pat. No. 5,613,988 (Th. Goldschmidt) and EP-A-849 352 (Th. Goldschmidt).

Dehazers are frequently incorporated into fuel oil compositions. Dehazers are typically polyoxyalkylene glycol derivatives, and polyoxyalkylene glycol dehazers include formaldehyde resins, which can be regarded as polyoxymethylene glycol derivatives, e.g. alkoxylated phenol formaldehyde polymer dehazers. Commercial examples of polyoxyalkylene glycol dehazers include dehazers available ex Nalco/Exxon Energy Chemicals Ltd and dehazers available under the "TOLAD" trade mark ex Petrolite Ltd.

DESCRIPTION OF THE INVENTION

It has now surprisingly been found that subjecting an organosilicone antifoam additive to a heat treatment and subsequently incorporating the resulting additive in a fuel oil composition together with a polyoxyalkylene glycol dehazer can result in enhanced antifoam performance being achieved in the fuel oil composition. Heat treatment of already formed fuel oil compositions, or of additive concentrates containing both organosilicone antifoam additive and polyoxyalkylene glycol dehazer before adding concentrate to fuel oil, has not been found to result in a similar effect.

According to the present invention there is provided a fuel oil composition comprising a major proportion of a liquid hydrocarbon middle distillate fuel oil, from 1 to 100 ppmw based on the composition of a polyoxy-alkylene glycol dehazer and from 1 to 100 ppmw based on the composition of an organosilicone antifoam additive, wherein before mixing of the organosilicone antifoam with any other component of the fuel oil composition, the organosilicone antifoam additive is heated at a temperature of at least 40° C. for a sufficient period of time to achieve improved antifoam properties of the fuel oil composition.

The organosilicone antifoam additive is preferably heated at a temperature in the range 40° C. to 80° C., preferably 40° C. to 65° C., more preferably 40° C. to 60° C.

The duration of the heat treatment will vary according to the temperature of the heat treatment and the specific organosilicone antifoam additive selected, and optimal combinations can readily be found by routine testing, as will be apparent in the examples given hereinafter.

The organosilicone antifoam additives are siloxane-containing compounds, and examples thereof are described, for examples, in U.S. Pat. Nos. 4,690,688 (Dow Corning), 5,542,960 (Osi Specialties) and 5,613,988 (Th. Goldschmidt) and EP-A-849 352 (Th. Goldschmidt). Commercially available examples are those available from Th Goldschmidt A. G. under the trade mark "TEGOPREN" (e.g. "T 5851" and "MR 2068"), from Dow Corning under the trade designation "Q25907", from Rhone Poulenc under the trade mark "RHODORSIL", and from Osi Specialties under the trade mark "SAG" (e.g. "TP-325" and "Y-14326").

The polyoxyalkylene glycol dehazer may consist of a single polyoxyalkylene glycol derivative, or it may contain more than one such derivative, and optionally an additional component or components which are not polyoxyalkylene glycol derivatives may be present. Polyoxyalkylene glycol dehazers include formaldehyde resins, which can be regarded as polyoxymethylene glycol derivatives, e.g. alkoxylated phenol formaldehyde polymer dehazers. Commercially such dehazers are available, for example, from Nalco/Exxon Energy Chemicals Ltd, e.g. the alkoxylated phenol formaldehyde polymer dehazers designated "EC5541A", "EC7115A" and "EC5642A", and from Petrolite Ltd under the "TOLAD" trade mark, e.g. the polyoxyalkylene dehazers designated "TOLAD 9318" and "TOLAD 9312".

The liquid hydrocarbon middle distillate fuel oil is derived from petroleum and will typically have a boiling range in the range 100° C. to 500° C., e.g. 150° C. to 400° C. Such petroleum-derived fuel oils may comprise atmospheric distillate or vacuum distillate, or cracked gas oil or a blend in any proportion of straight run and thermally and/or catalytically cracked distillates. Preferred fuel oil compositions of the invention are diesel fuel compositions. Diesel fuels typically have initial distillation temperature about 160° C. and final distillation temperature of 290–360° C., depending on fuel grade and use.

The fuel oil itself may be an additised (additive-containing) oil or an unadditised (additive-free) oil. If the fuel oil is an additised oil, it will contain minor amounts of one or more additives, e.g. one or more additives selected from anti-static agents, pipeline drag reducers, flow improvers (e.g. ethylene/vinyl acetate copolymers or acrylate/maleic anhydride copolymers) and wax anti-settling agents (e.g. those commercially available under the Trade Marks "PARAFLOW" (e.g. "PARAFLOW" 450; ex Paramins), "OCTEL" (e.g. "OCTEL" W 5000; ex Octel) and "DODIFLOW" (e.g. DODIFLOW" v 3958; ex Hoechst).

The fuel oil preferably has a sulphur content of at most 0.05% by weight (500 ppmw) ("ppmw" is parts per million by weight). Advantageous compositions of the invention are also attained when the sulphur content of the fuel oil is below 0.005% by weight (50 ppmw) or even below 0.001% by weight (10 ppmw).

The organosilicone antifoam additive and the polyoxyalkylene glycol dehazer may conveniently each be present in amounts up to 50 ppmw based on the fuel oil composition. The concentration of the polyoxyalkylene glycol dehazer is preferably in the range 1 to 20 ppmw, and more preferably 2 to 10 ppmw (e.g. about 5 ppmw). The concentration of the organosilicone antifoam additive is preferably in the range 1 to 20 ppmw, and more preferably 2 to 10 ppmw (e.g. about 5 ppmw). The relative concentrations organosilicone antifoam additive:polyoxyalkylene glycol dehazer are preferably in the range 1:10 to 10:1, more preferably 1:5 to 5:1, advantageously 2:5 to 5:2 and conveniently about 1:1.

Fuel oil compositions of the present invention may contain other additive components in addition to those already indicated. For example, a dispersant additive, e.g. a polyolefin substituted succinimide or succinamide of a polyamine, may be included. Such dispersant additives are described for example in UK Patent 960,493, EP-A-147 240, EP-A-482 253, EP-A-613 938, EP-A-557 561 and WO 9842808. Such dispersant additives are preferably present in amounts in the range of from 10 to 400 ppmw, more preferably 40 to 200 ppmw, active matter based on the fuel oil composition.

When the liquid hydrocarbon middle distillate fuel oil has a sulphur content of 500 ppmw or less, the fuel oil composition preferably additionally contains a lubricity enhancer in an amount in the range from 50 to 500 ppmw based on the fuel oil composition. Commercially available lubricity enhancers include those available as "EC 831" and "PARADYNE (trade mark) 655" ex Exxon Chemical Ltd, "HITEC" (trade mark) E 580 ex Ethyl Corporation and "VECTRON" (trade mark) 6010 ex Shell Additives International Ltd.

Further additional additive components which may be present include ignition improvers (cetane improvers) (e.g. 2-ethylhexyl nitrate, cyclohexyl nitrate, ditertiarybutyl peroxide and those disclosed in U.S. Pat. No. 4,208,190 (at Column 2, line 27 to Column 3, line 21); anti-rust agents (e.g. that commercially sold by Rhein Chemie, Mannheim, Germany as "RC 48011", a propane-1,2-diol semiester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid), reodorants, antiwear additives; anti-oxidants (e.g. phenolics such as 2,6-di-tert-butylphenol, or phenylenediamines such as N,N'-di-sec-butyl-p-phenylenediamine); and metal deactivators. A reodorant may be included, if desired.

The concentration of the ignition improver in the fuel is preferably in the range 0 to 600 ppmw, e.g. 300 to 500 ppmw. Concentrations of other additives not yet specified are each preferably in the range 0 to 20 ppmw.

The present invention further provides a process for the preparation of a fuel oil composition according to the invention, as defined above, which comprises heating the organosilicone antifoam additive at the temperature of at least 40° C. for the sufficient period of time, and admixing the resulting organosilicone antifoam additive, the polyoxyalkylene glycol dehazer, and optionally other additive components with the fuel oil.

Advantageously, this process may comprise admixing the resulting organosilicone antifoam additive, the polyoxyalkylene glycol dehazer and optionally other additive components, to form an additive concentrate, and thereafter admixing the additive concentrate with the fuel oil.

Where an additive concentrate is prepared, it is preferred to have present as one of the additive components a fuel-compatible diluent, which may be a carrier oil (e.g. a mineral oil), a polyether, which may be capped or uncapped, a non-polar solvent such as toluene, xylene, white spirits and those sold by member companies of the Royal Dutch/Shell Group under the Trade Mark "SHELLSOL", and/or a polar solvent such as esters and, in particular, alcohols, e.g. hexanol, 2-ethylhexanol, decanol, isotridecanol and alcohol mixtures such as those sold by member companies of the Royal Dutch/Shell Group under the Trade Mark "LINEVOL", especially "LINEVOL" 79 alcohol which is a mixture of $C_{7-9}$ primary alcohols, or the $C_{12-14}$ alcohol mixture commercially available from Sidobre Sinnova, France under the Trade Mark "SIPOL".

The invention still further provides a method of fuelling a road vehicle equipped with a compression-ignition engine and a fuel tank therefor which comprises introducing into the fuel tank a composition according to the invention, as defined above.

In this description, all parts and percentages are by weight, unless stated otherwise, and the term "comprises" is used in the sense of "contains" or "includes", and not in the sense of "consists of", unless the context requires otherwise.

EXAMPLES

The present invention will be further understood from the following illustrative examples, in which various terms have the following significance.

Detergent A is the reaction product of a polyisobutenyl succinic anhydride in which the number average molecular weight of the polyisobutenyl chain (PIB Mn) is 950 with tetraethylene pentamine (TEPA), closely corresponding to Dispersant Additive Test Material 1 of WO 984288.

Detergent B is the reaction product of a polyisobutenyl succinic anhydride in which the number average molecular weight of the polyisobutenyl chain (PIB Mn) is 950 with tetraethylene pentamine (TEPA), closely corresponding to Dispersant Additive Test Material Comp. A of WO 9842808.

2-EHN Cetane improver is 2-ethylhexylnitrate.

2-EHA Solvent is 2-ethylhexanol.

"LINEVOL 79" Solvent ("LINEVOL" is a trade mark) is a blend of $C_{7-9}$ primary alcohols available from member companies of the Royal Dutch/Shell group.

"P-655" Lubricity enhancer is a synthetic ester-containing lubricity additive available ex Exxon Chemical Ltd., Fareham, UK, under the trade designation "PARADYNE 655" ("PARADYNE" is a trade mark).

"VECTRON 6010" Lubricity enhancer ("VECTRON" is a trade mark) is an organic acid-containing lubricity additive available ex Shell Additives International Ltd., Shell Centre, London, UK.

Anti-rust agent C is a hydroxypropyl ester of tetrapropenyl succinic acid (propane-1,2-diol semiester of tetrapropenyl succinic acid) (c.f. Example IV of UK Patent 1,306,233).

Reodorant is a proprietary ester- and ketone-containing reodorant.

"EC5541A", "EC7115A" and "EC5642A" (formerly "NALCO 7D-07"), Dehazers are polyoxyalkylene glycol dehazers, more specifically alkoxylated phenol formaldehyde polymer dehazers, available ex Nalco/Exxon Energy Chemicals Ltd., Fareham, UK ("NALCO" is a trade mark).

"TOLAD 9318" Dehazer and "TOLAD 9312" Dehazer ("TOLAD" is a trade mark) are polyoxyalkylene glycol dehazers available ex Petrolite Limited, Liverpool, UK.

"TP-325" Antifoam and "Y-14326" Antifoam, available ex Osi Specialties (UK) Ltd, Harefield, UK, and "MR-2068" Antifoam, available ex Th-Goldschmidt, Essen, Germany, are all organosilicone (siloxane-containing) antifoam additives.

In the examples, the following Methods are referred to (Methods A to E).

Method A:

The specified liquid was heat treated according to the following method:

The stated amount of the specified liquid was put into a container. The container was then sealed with a screw cap. The container was then placed in a pre-heated oven at the specified temperature (see examples). The liquid was left in the oven in the container for the specified number of hours, then removed and left to cool down to ambient temperature (20° C.) with the screw cap still in place for approximately 10 minutes. After 10 minutes, the screw cap was removed and the temperature of the specified liquid was checked to be consistent with ambient temperature. Blends were then prepared according to Method B.

See example tables for specified conditions.

Method B:

Additive packages were blended in accordance with the following method:

The additive package components were measured out by mass using a digital balance into a glass container. The masses and dose rates of the additives package components in the fuel are shown below.

The antifoam component was added to the other package components in the amount shown in the tables below. The components were measured out into the container in the order shown in the tables below. The container with all the package components in was sealed and then shaken to thoroughly mix the additive package.

| Additive Package Component | Dose Rate in Fuel (ppmw) | Mass of Component Blended (grams) |
|---|---|---|
| Additive Package a: Used in Examples 1,2,5 and 6 | | |
| Detergent A | 150 | 7.5 |
| 2-EHN Cetane improver | 300 | 15.0 |
| 2-EHA Solvent | 100 | 5.0 |
| "P-655" Lubricity enhancer | 100 | 5.0 |
| "EC5541A" Dehazer | 5 | 0.25 |
| "VECTRON 6010" Lubricity enhancer | 25 | 1.25 |
| Reodorant | 25 | 1.25 |
| "TP-325" Antifoam | 5 | 0.25 |
| Total Treat Rate = 710 ppmw | Total Mass Of Package = 35.5 g | |
| Additive Package b: Used in Example 3 | | |
| Detergent A | 150 | 7.5 |
| 2-EHN Cetane improver | 300 | 15.0 |
| 2-EHA Solvent | 100 | 5.0 |
| "P-655" Lubricity enhancer | 100 | 5.0 |
| "EC5541A" Dehazer | 5 | 0.25 |
| "VECTRON 6010" Lubricity enhancer | 25 | 1.25 |
| Reodorant | 25 | 1.25 |
| "Y-14326" Antifoam | 5 | 0.25 |
| Total Treat Rate = 710 ppmw | Total Mass Of Package = 35.5 g | |
| Additive Package c: Used in Example 4 | | |
| Detergent A | 150 | 7.5 |
| 2-EHN Cetane improver | 300 | 15.0 |
| 2-EHA Solvent | 100 | 5.0 |
| "P-655" Lubricity enhancer | 100 | 5.0 |
| "EC5541A" Dehazer | 5 | 0.25 |
| "VECTRON 6010" Lubricity enhancer | 25 | 1.25 |
| Reodorant | 25 | 1.25 |
| "MR-2068" Antifoam | 5 | 0.25 |
| Total Treat Rate = 710 ppmw | Total Mass Of Package = 35.5 g | |
| Additive Package d: Used in Example 6 | | |
| Detergent A | 150 | 7.5 |
| 2-EHN Cetane improver | 300 | 15.0 |
| 2-EHA Solvent | 100 | 5.0 |
| "P-655" Lubricity enhancer | 100 | 5.0 |
| "EC5541A" Dehazer | 5 | 0.25 |
| "VECTRON 6010" Lubricity enhancer | 25 | 1.25 |
| Reodorant | 25 | 1.25 |
| "TP-325" Antifoam | 2 | 0.1 |
| Total Treat Rate = 707 ppmw | Total Mass Of Package = 35.35 g | |
| Additive Package e: Used in Example 6 | | |
| Detergent A | 150 | 7.5 |
| 2-EHN Cetane improver | 300 | 15.0 |
| 2-EHA Solvent | 100 | 5.0 |
| "P-655" Lubricity enhancer | 100 | 5.0 |
| "EC5541A" Dehazer | 5 | 0.25 |
| "VECTRON 6010" Lubricity enhancer | 25 | 1.25 |
| Reodorant | 25 | 1.25 |
| "TP-325" Antifoam | 8 | 0.4 |
| Total Treat Rate = 713 ppmw | Total Mass Of Package = 35.65 g | |
| Additive Package f: Used in Example 6 | | |
| Detergent A | 150 | 7.5 |
| 2-EHN Cetane improver | 300 | 15.0 |
| 2-EHA Solvent | 100 | 5.0 |
| "P-655" Lubricity enhancer | 100 | 5.0 |
| "EC5541A" Dehazer | 5 | 0.25 |
| "VECTRON 6010" Lubricity enhancer | 25 | 1.25 |
| Reodorant | 25 | 1.25 |
| "TP-325" Antifoam | 10 | 0.5 |
| Total Treat Rate = 715 ppmw | Total Mass Of Package = 35.75 g | |
| Additive Package g: Used in Example 7 | | |
| Detergent A | 150 | 7.5 |
| 2-EHA Solvent | 100 | 5.0 |
| "TP-325" Antifoam | 5 | 0.5 |
| Total Treat Rate = 255 ppmw | Total Mass Of Package = 13.0 g | |
| Additive Package h: Used in Examples 7 and 8 | | |
| 2-EHA Solvent | 100 | 5.0 |
| "EC5541A" Dehazer | 5 | 0.25 |
| "TP-325" Antifoam | 5 | 0.5 |
| Total Treat Rate = 110 ppmw | Total Mass Of Package = 5.75 g | |
| Additive Package i: Used in Example 7 | | |
| 2-EHA Solvent | 100 | 5.0 |
| "VECTRON 6010" Lubricity enhancer | 25 | 1.25 |
| "TP-325" Antifoam | 10 | 0.5 |
| Total Treat Rate = 135 ppmw | Total Mass Of Package = 6.75 g | |
| Additive Package j: Used in Example 7 | | |
| Detergent A | 150 | 7.5 |
| 2-EHA Solvent | 100 | 5.0 |
| "EC5541A" Dehazer | 5 | 0.25 |
| "TP-325" Antifoam | 10 | 0.5 |
| Total Treat Rate = 265 ppmw | Total Mass Of Package = 13.25 g | |
| Additive Package k: Used in Example 7 | | |
| Detergent A | 150 | 7.5 |
| 2-EHN Cetane improver | 300 | 15.0 |
| 2-EHA Solvent | 100 | 5.0 |
| "TP-325" Antifoam | 10 | 0.5 |
| Total Treat Rate = 560 ppmw | Total Mass Of Package = 28.0 g | |
| Additive Package l: Used in Example 7 | | |
| 2-EHN Cetane improver | 300 | 15.0 |
| 2-EHA Solvent | 100 | 5.0 |
| "EC5541A" Dehazer | 5 | 0.25 |
| "TP-325" Antifoam | 10 | 0.5 |
| Total Treat Rate = 415 ppmw | Total Mass Of Package = 20.75 g | |

-continued

| Additive Package Component | Dose Rate in Fuel (ppmw) | Mass of Component Blended (grams) |
|---|---|---|
| Additive Package m: Used in Example 7 | | |
| 2-EHN Cetane improver | 300 | 15.0 |
| 2-EHA Solvent | 100 | 5.0 |
| "TP-325" Antifoam | 10 | 0.15 |
| Total Treat Rate = 410 ppmw | Total Mass Of Package = 20.5 g | |
| Additive Package n: Used in Example 8 | | |
| 2-EHA Solvent | 100 | 5.0 |
| "EC5642A" Dehazer | 5 | 0.25 |
| "TP-325" Antifoam | 5 | 0.25 |
| Total Treat Rate = 110 ppmw | Total Mass Of Package = 5.5 g | |
| Additive Package o: Used in Example 8 | | |
| 2-EHA Solvent | 100 | 5.0 |
| "EC7115A" Dehazer | 5 | 0.25 |
| "TP-325" Antifoam | 5 | 0.25 |
| Total Treat Rate = 110 ppmw | Total Mass Of Package = 5.5 g | |
| Additive Package p: Used in Example 8 | | |
| 2-EHA Solvent | 100 | 5.0 |
| "Tolad 9318" Dehazer | 5 | 0.25 |
| "TP-325" Antifoam | 5 | 0.25 |
| Total Treat Rate = 110 ppmw | Total Mass Of Package = 15.5 g | |
| Additive Package q: Used in Example 8 | | |
| 2-EHA Solvent | 100 | 5.0 |
| "Tolad 9312" Dehazer | 5 | 0.25 |
| "TP-325" Antifoam | 5 | 0.25 |
| Total Treat Rate = 110 ppmw | Total Mass Of Package = 5.5 g | |
| Additive Package a2: Used in Example 9 | | |
| Detergent A | 150 | 10.5 |
| 2-EHN Cetane improver | 300 | 21.0 |
| 2-EHA Solvent | 100 | 7.0 |
| "P-655" Lubricity enhancer | 100 | 7.0 |
| "EC5541A" Dehazer | 5 | 0.35 |
| "VECTRON 6010" Lubricity enhancer | 25 | 1.75 |
| Reodorant | 25 | 1.75 |
| "TP-325" Antifoam | 5 | 0.35 |
| Total Treat Rate = 710 ppmw | Total Mass Of Package = 49.7 g | |
| Additive Package r: Used in Example 9 | | |
| Detergent A | 300 | 21.0 |
| 2-EHN Cetane improver | 300 | 21.0 |
| 2-EHA Solvent | 175 | 12.25 |
| "EC5541A" Dehazer | 5 | 0.35 |
| "VECTRON 6010" Lubricity enhancer | 225 | 15.75 |
| Reodorant | 25 | 1.75 |
| Antifoam | 5 | 0.35 |
| Total Treat Rate = 1035 ppmw | Total Mass Of Package = 72.45 g | |
| Additive Package s: Used in Example 9 | | |
| Detergent B | 300 | 21.0 |
| "Linevol 7–9" Solvent | 25 | 1.75 |
| 2-EHN Cetane improver | 300 | 21.0 |
| Anti-rust agent C | 5 | 0.35 |
| "EC5541A" Dehazer | 5 | 0.35 |
| "TP-325" Antifoam | 5 | 0.35 |
| Total Treat Rate = 640 ppmw | Total Mass Of Package = 44.8 g | |
| Additive Package t: Used in Example 9 | | |
| Detergent A | 150 | 10.5 |
| 2-EHN Cetane improver | 300 | 21.0 |
| 2-EHA Solvent | 175 | 12.25 |

-continued

| Additive Package Component | Dose Rate in Fuel (ppmw) | Mass of Component Blended (grams) |
|---|---|---|
| "EC7511A" Dehazer | 5 | 0.35 |
| "VECTRON 6010" Lubricity enhancer | 225 | 15.75 |
| Reodorant | 25 | 1.75 |
| "Y-14326" Antifoam | 5 | 0.35 |
| Total Treat Rate = 885 ppmw | Total Mass Of Package = 61.95 g | |

Method C:

The additive package was blended into the base fuel according to the following method.

The amount of additive package to add to the specified mass of base fuel to achieve a desired concentration was calculated.

For example, the total mass of an additive package of desired treat rate 710 ppm in 500 g of base fuel is 0.355 g.

The calculated mass of the prepared additive package was measured out into a metal can. The specified mass of base fuel was then added and the can was sealed. The base fuel and additive package in the can were then shaken together to ensure thorough mixing.

Method D:

This is industry standard NFM 07-075:1995 antifoam test. Where results are indicated as being statistically significant, those are assessed by a standard statistical method (BS 2846, Part 4).

Method E:

Carboy Filling Test

A clean twenty-liter conical-necked glass vessel (carboy) is positioned on industrial scales of 50 kg capacity. Fuel is dispensed by a fuel pump of 40 l/min nominal capacity through a standard garage forecourt fuel-dispensing nozzle, with the nozzle outlet 4 cm below the vessel neck opening. Fuel is dispensed into the vessel simultaneously with starting a stopwatch. The fuel is dispensed until fuel and foam reach the top of the jar. Flow of fuel is stopped, and the stopwatch is stopped. Weight of fuel in the jar and time (in seconds) are noted (initial fill). After 10 seconds, fuel flow and stopwatch are restarted, and both are stopped when fuel and foam reach the top of the jar (second fill). Total weight and elapsed time on stopwatch are noted. This procedure is repeated in like manner for third and fourth fills. After the fourth fill, foam is allowed to disperse until an area of clear fuel is visible on the surface. Fuel is then introduced in spurts until the jar is full. Total time and weight are noted. Graphs of weight vs time are plotted, and from these are derived % fill at initial fill, time to 98% fill and time to 100% fill.

In the following examples, four different base fuels were used as indicated. All were produced by European refineries to meet current EN590 specifications. The properties of the fuels are given below.

Properties of base fuel:

| PROPERTIES | |
|---|---|
| | Base Fuel w |
| DENSITY @ 15° C. (IP365/ASTM D4052) g/cm$^3$ | 0.8333 |
| DISTILLATION (IP123/ASTM D86) | |
| IBP ° C. | 163.0 |
| 10% | 203.0 |
| 20% | 225.0 |
| 30% | 248.0 |
| 40% | 268.0 |
| 50% | 285.0 |
| 60% | 302.0 |
| 70% | 316.0 |
| 80% | 331.0 |
| 90% | 347.0 |
| 95% | 358.0 |
| FBP | 374.0 |
| CETANE NUMBER ASTM D613 | 52.1 |
| SULPHUR (IP373) ppmw | 500 |
| | Base Fuel x |
| DENSITY @ 15° C. (IP365/ASTM D4052) g/cm$^3$ | 0.8551 |
| DISTILLATION (IP123/ASTM D86) | |
| IBP ° C. | 207.0 |
| 10% | 250.0 |
| 20% | 264.0 |
| 30% | 275.0 |
| 40% | 285.0 |
| 50% | 298.0 |
| 60% | 303.0 |
| 70% | 312.0 |
| 80% | 324.0 |
| 90% | 338.0 |
| 95% | 349.0 |
| FBP | 369.0 |
| CETANE NUMBER ASTM D613 | 50.1 |
| SULPHUR (IP373) ppmw | 300 |
| | Base Fuel y |
| DENSITY @ 15° C. (IP365/ASTM D4052) g/cm$^3$ | 0.8312 |
| DISTILLATION (IP123/ASTM D86) | |
| IBP ° C. | 170.0 |
| 10% | 205.0 |
| 20% | 221.0 |
| 30% | 239.0 |
| 40% | 255.0 |
| 50% | 274.0 |
| 60% | 288.0 |
| 70% | 299.0 |
| 80% | 312.0 |
| 90% | 328.0 |
| 95% | 339.0 |
| FBP | 357.0 |
| CETANE NUMBER ASTM D613 | 53.3 |
| SULPHUR (IP373) ppmw | 400 |
| | Base Fuel z |
| DENSITY @ 15° C. (IP365/ASTM D4052) g/cm$^3$ | 0.8443 |
| DISTILLATION (IP123/ASTM D86) | |
| IBP ° C. | 164.0 |
| 10% | 206.0 |
| 20% | 228.0 |
| 30% | 238.0 |
| 40% | 254.0 |

-continued

Properties of base fuel:

| PROPERTIES | |
|---|---|
| 50% | 268.0 |
| 60% | 283.0 |
| 70% | 297.0 |
| 80% | 312.0 |
| 90% | 328.0 |
| 95% | 339.0 |
| FBP | 363.0 |
| CETANE NUMBER ASTM D613 | 53.0 |
| SULPHUR (IP373) ppmw | 370 |

Example 1

This example is designed to show the effect produced by heat treating the antifoam component of the additive package prior to blending the additive package. Base fuel w and additive package a were used in this example. The specified temperature for this example as referred to in Method A is 50° C.

The specified mass of base fuel as referred to in Method C is 500 g.

The duration of the heat treatment of the antifoam as referred to in Method A was 72 hours in each case. Specific conditions used to generate the examples are given in Table 1 below.

In Examples 1a and 1b the antifoam liquid was heat treated according to Method A. The additive package was blended according to Method B. Method C was employed to blend the additive package with the base fuel.

Fuel sample Comparative A was blended according to Method B, excepting that the antifoam component of the additive package was not heat treated (Method A). Fuel sample Comparative B was blended via Method C with an additive package consisting of only the heat treated liquid antifoam (Method A).

Fuel sample Comparative C was prepared according to Method C using a heat treated complete additive package to dose the base fuel. In this case, the additive package was blended according to Method B but using a non-heat treated antifoam liquid. The complete additive package was then heat treated according to Method A. The base fuel was then dosed with the heat treated additive package after it had cooled down to ambient temperature (20° C.) (Method C).

Comparative D was prepared by heat treating the dosed fuel. The additive package was prepared as for Comparative C (with a non heat treated antifoam liquid). The base fuel was dosed with the additive according to Method C. The 500 g of dosed fuel was then heat treated according to Method A. The heat treated fuel was then left to cool down to ambient temperature (20° C.) for at least twenty minutes. The cap was then removed and the temperature was checked to be consistent with ambient temperature.

Method D was used to test the fuels after the blending procedures were completed. In the case of Example 1a and the comparative examples, testing was done directly after blending. In the case of Example b, testing was done after standing for 48 hours at ambient temperature (20° C.).

Statistically significant results are indicated by*

TABLE 1

| Sample | Foam Volume (ml) (±(2.604)ml | Dissipation time(s) ±(1.054)s |
|---|---|---|
| Example 1a | 40* | 6* |
| Comp. A | 58 | 9 |
| Comp. B | 57 | 9 |
| Comp. C | 55 | 8 |
| Comp. D | 54 | 8 |
| Example 1b | 43* | 6* |

It will be noted that the foam volume and dissipation time parameters for Example 1a and 1b are surprisingly superior to those for base fuel alone (Comparative A), fuel containing heat-treated antifoam as sole additive (Comparative B), fuel containing additive package wherein the formulated additive package is heat-treated (Comparative C) and fuel which is heat-treated after addition of additive package (Comparative D).

Example 2

This example is designed to show the effect that the duration of heat treatment of the antifoam liquid has on the effect shown in Example 1.

Base fuel x and additive package a were used in this example.

The specified temperature for this example as referred to in Method A is 50° C.

The specified mass of base fuel as referred to in Method C is 500 g.

The fuel samples for Comparatives F–J and Examples 2a–2l were prepared in the following way. The antifoam liquid was heat treated according to Method A. The specified number of hours for the heat treatment as referred to in Method A are given in Table 2. The additive packages were blended according to Method B. Method C was employed to blend the additive packages with the base fuel.

Fuel sample Comparative E was blended according to Method B, excepting that the antifoam component of the additive package was not heat treated (Method A). Method C was employed to blend the additive packages with the base fuel.

Method D was used to test the fuel samples after the blending procedures were completed.

Results and duration of heat treatment (hours) are given in Table 2 following, in which statistically significant results are indicated by *:

TABLE 2

| Sample | Duration of Heat Treatment (hours) | Foam Volume (ml) ±(2.604)ml | Dissipation time(s) ±(1.054)s |
|---|---|---|---|
| Comp. E | 0 | 52 | 16 |
| Comp. F | 1 | 54 | 15 |
| Comp. G | 2 | 49 | 15 |
| Comp. H | 4 | 48 | 15 |
| Comp. I | 6 | 48 | 14 |
| Comp. J | 7 | 51 | 15 |
| Example 2a | 8 | 47* | 14* |
| Example 2b | 18 | 43* | 14* |
| Example 2c | 23 | 40* | 15* |
| Example 2d | 42 | 40* | 14* |
| Example 2e | 44 | 40* | 12* |

TABLE 2-continued

| Sample | Duration of Heat Treatment (hours) | Foam Volume (ml) ±(2.604)ml | Dissipation time(s) ±(1.054)s |
|---|---|---|---|
| Example 2f | 46 | 38* | 12* |
| Example 2g | 48 | 38* | 11* |
| Example 2h | 72 | 38* | 10* |
| Example 2i | 96 | 40* | 10* |
| Example 2j | 120 | 38* | 10* |
| Example 2k | 144 | 38* | 11* |
| Example 2l | 168 | 37* | 10* |

Example 3

This example is designed to show the effect that the duration of heat treatment of the antifoam liquid has on the effect shown in Example 1.

Base fuel w and additive package b were used in this example.

The specified temperature for this example as referred to in Example A is 50° C.

The specified mass of base fuel as referred to in Method C is 500 g.

The fuel samples for Comparative L and Examples 3a–3c were prepared in the following way. The antifoam liquid was heat treated according to Method A. The specified number of hours for the heat treatment as referred to in Method A are given in Table 3. The additive packages were blended according to Method B. Method C was employed to blend the additive packages with the base fuel.

Fuel sample Comparative K was blended according to Method B, excepting that the antifoam component of the additive package was not heat treated (Method A). Method C was employed to blend the additive package with the base fuel.

Method D was used to test the fuel samples after the blending procedures were completed.

Results and duration of heat treatment are given in Table 3 following in which statistically significant results are indicated by *:

TABLE 3

| Sample | Duration of Heat Treatment (hours) | Foam Volume (ml) ±(2.604)ml | Dissipation time(s) ±(1.054)s |
|---|---|---|---|
| Comp. K | 0 | 64 | 10 |
| Comp. L | 24 | 63 | 11 |
| Example 3a | 48 | 41* | 6* |
| Example 3b | 72 | 43* | 5* |
| Example 3c | 96 | 44* | 4* |

Example 4

This example is designed to show the effect that the duration of heat treatment of the antifoam liquid has on the effect shown in Example 1.

Base fuel w and additive package c were used in this example.

The specified temperature for this example as referred to in Method A is 50° C.

The specified mass of base fuel as referred to in Method C is 500 g.

The fuel samples for Comparative N and Examples 4a–4c were prepared in the following way. The antifoam liquid was heat treated according to Method A. The specified number of hours for the heat treatment as referred to in Method A are given in Table 4. The additive packages were blended according to Method B. Method C was employed to blend the additive packages with the base fuel.

Fuel sample Comparative M was blended according to Method B, excepting that the antifoam component of the additive package was not heat treated (Method A). Method C was employed to blend the additive package with the base fuel.

Method D was used to test the fuel samples after the blending procedures were completed.

Results and duration of heat treatment are given in Table 4 following, in which statistically significant results are indicated by *:

TABLE 4

| Sample | Duration of Heat Treatment (hours) | Foam Volume (ml) ±(2.604)ml | Dissipation time(s) ±(1.054)s |
|---|---|---|---|
| Comp. M | 0 | 62 | 10 |
| Comp. N | 24 | 61 | 10 |
| Example 4a | 48 | 48* | 7* |
| Example 4b | 72 | 43* | 6* |
| Example 4c | 96 | 43* | 6* |

Example 5

This example is designed to show the effect that the temperature of the oven during the heat treatment in addition to the duration of the heat treatment has on the effect shown in Example 1.

Base fuel w and additive package a were used in this example.

The specified temperatures for this example as referred to in Method A are given in Table 5 below.

The specified mass of diesel fuel as referred to in Method C is 500 g.

The fuel samples for Comparative P and Q and Examples 5a–5j were prepared in the following way. The antifoam liquid was heat treated according to Method A. The specified number of hours for the heat treatment as referred to in Method A are given in Table 5. The specified temperatures for the heat treatment as referred to in Method A are also given in Table 5. The additive packages were blended according to Method B. Method C was employed to blend the additive packages with the base fuel.

Fuel sample Comparative O was blended according to Method B, excepting that the antifoam component of the additive package was not heat treated. Method C was employed to blend the additive package with the base fuel.

Method D was used to test the fuel samples after the blending procedures were completed.

Preparation conditions and results are given in Table 5 following, in which statistically significant results are indicated by *:

TABLE 5

| Sample | Temperature (° C.) | Duration of Heat Treatment (hours) | Foam Volume (ml) ±(2.604)ml | Dissipation time(s) ±(1.054)s |
|---|---|---|---|---|
| Comp. O | N/A | 0 | 39 | 6 |
| Comp. P | 40 | 24 | 39 | 5 |
| Example 5a | 40 | 48 | 35* | 5* |
| Ex. 5b | 40 | 72 | 35* | 6* |
| Ex. 5c | 40 | 96 | 35* | 5* |
| Comp. Q | 50 | 24 | 39 | 5 |
| Ex. 5d | 50 | 48 | 33* | 4* |
| Ex. 5e | 50 | 72 | 31* | 4* |
| Ex. 5f | 50 | 96 | 31* | 4* |
| Ex. 5g | 60 | 24 | 31* | 4* |
| Ex. 5h | 60 | 48 | 32* | 4* |
| Ex. 5i | 60 | 72 | 33* | 4* |
| Ex. 5j | 60 | 96 | 31* | 4* |

Example 6

This example is designed to show the effect that the concentration of the heat treated antifoam liquid in the fuel has on the effect shown in Example 1.

Base fuel x and additive packages a, d, e and f were used in this example.

The specified temperature for this example as referred to in Method A is 50° C.

The duration of the heat treatment of the antifoam as referred to in Method A is 72 hours in each case.

The specified mass of base fuel as referred to in Method C is 500 g.

The fuel samples for Examples 6a–6d were prepared in the following way. The antifoam liquid was heat treated according to Method A. The additive packages were blended according to Method B. Method C was employed to blend the additive packages with the Diesel fuel.

Fuel samples Comparatives R–U were blended according to Method B, excepting that the antifoam component of the additive package was not heat treated. Method C was employed to blend the additive packages with the base fuel.

Method D was used to test the fuel samples after the blending procedures were completed.

Preparation details and results are given in Table 6 following, in which statistically significant results are indicated by*:

TABLE 6

| Sample | Package | Antifoam Concentration in Fuel (ppmw) | Foam Volume (ml) ±(2.604)ml | Dissipation time(s) ±(1.054)s |
|---|---|---|---|---|
| Comp. R | d | 2 | 37 | 14 |
| Ex. 6a | d | 2 | 31* | 13 |
| Comp. S | a | 5 | 28 | 12 |
| Ex. 6b | a | 5 | 25* | 10* |
| Comp. T | e | 8 | 25 | 11 |
| Ex. 6c | e | 8 | 19* | 8* |
| Comp. U | g | 10 | 23 | 10 |
| Ex. 6d | g | 10 | 21* | 8* |

Example 7

This example is designed to show the effect that the exclusion of different components of the additive package has on the effect shown in Example 1.

Base fuel w and additive packages g–m were used in this example.

The specified temperature for this example as referred to in Method A is 50° C.

The duration of the heat treatment of the antifoam as referred to in Method a was 72 hours in each case.

The specified mass of base fuel as referred to in Method C is 500 g.

The fuel samples for Comparatives W, Z, CC and FF and Examples 7a–7c were prepared in the following way. The antifoam liquid was heat treated according to Method A. The additive packages were blended according to Method B. Method C was employed to blend the additive packages with the base fuel.

Fuel samples for Comparatives V, X, Y, AA, BB, DD and EE, were blended according to Method B, excepting that the antifoam component of the additive package was not heat treated (Method A). Method C was employed to blend the additive packages with the base fuel.

Method D was used to test the fuel samples after the blending procedures were completed.

Package specification and results are given in Table 7 following, in which, statistically significant results are indicated by*:

TABLE 7

| Sample | Complete Additive Package | Foam Volume (ml) ±(2.604)ml | Dissipation time(s) ±(1.054)s |
|---|---|---|---|
| Comp. V | g | 38 | 10 |
| Comp. W | g | 37 | 9 |
| Comp. X | h | 45 | 8 |
| Ex. 7a | h | 38* | 5* |
| Comp. Y | i | 43 | 11 |
| Comp. Z | i | 40 | 11 |
| Comp. AA | j | 37 | 10 |
| Ex. 7b | j | 35* | 6* |
| Comp. BB | k | 49 | 14 |
| Comp. CC | k | 48 | 12 |
| Comp. DD | l | 50 | 9 |
| Ex. 7c | l | 43* | 6* |
| Comp. EE | m | 46 | 9 |
| Comp. FF | m | 45 | 9 |

It will be noted that each of Examples 7a, b and c contain both antifoam and dehazer components. Compositions omitting this combination failed.

Example 8

This example is designed to further show the effect that the exclusion of different components of the additive package has on the effect shown in Example 1.

Base fuel w and additive packages n–p were used in this example.

The specified temperature for this example as referred to in Method A is 50° C.

The duration of the heat treatment of the antifoam as referred to in Method A was 72 hours in each case.

The specified mass of base fuel as referred to in Method C is 500 g.

The fuel samples for Examples 7a, 8a–c were prepared in the following way. The antifoam liquid was heat treated according to Method A. The additive packages were blended according to Method B. Method C was employed to blend the additive packages with the base fuel.

Fuel samples for Comparatives X, GG, HH, II and JJ were blended according to Method B, excepting that the antifoam component of the additive package was not heat treated. Method C was employed to blend the additive packages with the base fuel.

Method D was used to test the fuel samples after the blending procedures were completed.

Package specification and results are given in Table 8 following, in which statistically significant results are indicated by*:

TABLE 8

| Sample | Complete Additive Package | Foam Volume (ml) ±(2.604) ml | Dissipation time(s) ±(1.054) s |
|---|---|---|---|
| Comp. X | h | 45 | 8 |
| Ex. 7a | h | 38* | 5* |
| Comp. GG | n | 38 | 9 |
| Ex. 8a | n | 33* | 7* |
| Comp. HH | o | 41 | 8 |
| Ex. 8b | o | 34* | 6* |
| Comp. II | p | 36 | 8 |
| Ex. 8c | p | 33* | 8 |
| Comp. JJ | q | 38 | 7 |
| Ex. 8D | q | 35* | 7 |

It will be noted that each of Examples 7a and 8a, b, c and d contains both antifoam and dehazer components.

Example 9

This example is designed to further demonstrate the effect shown in Example 1 by means of another method of testing the fuel samples.

Base fuels x, y and z and additive packages a2 and r to t were used in this example.

The specified temperature for this example as referred to in Method A is 50° C.

The duration of the heat treatment of the antifoam as referred to in Method A was 72 hours in each case.

The specified mass of base fuel as referred to in Method C is 70 Kg.

The fuel samples for Example 9a–9g were prepared in the following way. The antifoam liquid was heat treated according to Method A. The additive packages were blended according to Method B. Method C was employed to blend the additive packages with the base fuel.

Fuel samples for Comparative KK–QQ were blended according to Method B, excepting that the antifoam component of the additive package was not heat treated. Method C was employed to blend the additive packages with the base fuel.

Method E was used to test the fuel samples after the blending procedures were completed.

Package specification and results in Table 9 following:

TABLE 9

| Sample | Complete Additive Package | Initial Fill % | Time to 98% Fill (s) | Time to 100% Fill (s) |
|---|---|---|---|---|
| Comp. KK | a2 | 87 | 135 | 155 |
| Ex. 9a | a2 | 96 | 36 | 51 |
| Comp. LL | r | 94 | 47 | 63 |
| Ex. 9b | r | 94 | 41 | 61 |
| Comp. MM | s | 88 | 11 | 197 |
| Ex. 9c | s | 94 | 41 | 63 |
| Comp. NN | r | 91 | 55 | 98 |

TABLE 9-continued

| Sample | Complete Additive Package | Initial Fill % | Time to 98% Fill (s) | Time to 100% Fill (s) |
|---|---|---|---|---|
| Ex. 9d | r | 93 | 50 | 88 |
| Comp. OO | s | 90 | 60 | 76 |
| Ex. 9e | s | 93 | 53 | 71 |
| Comp. PP | t | 87 | 68 | 87 |
| Ex. 9f | t | 91 | 58 | 79 |
| Comp. QQ | t | 94 | 49 | 104 |
| Ex. 9g | t | 95 | 42 | 57 |

It will be noted that each of Examples 9 a, b, c, d, e, f and g contains both antifoam and dehazer components.

What is claimed is:

1. A process for the preparation of a fuel oil composition comprising:

heating an organosilicone antifoam additive at a temperature of at least 40° C. for a sufficient period of time to achieve improved antifoam properties of the fuel oil composition; and, admixing from 1 to 100 ppmw based on the fuel composition of the resulting antifoam additive and from 1 to 100 ppmw based on the fuel composition of a polyoxyalkylene glycol dehazer with a liquid hydrocarbon middle distillate fuel oil, and optionally other additives.

2. A process according to claim 1 which comprises admixing the resulting organosilicone antifoam additive, the polyoxyalkylene glycol dehazer and optionally other additive components, to form an additive concentrate, and thereafter admixing the additive concentrate with the fuel oil.

3. The composition produced by the process of claim 1.

* * * * *